US011883712B2

(12) United States Patent
Aoki

(10) Patent No.: US 11,883,712 B2
(45) Date of Patent: Jan. 30, 2024

(54) FOOT-PEDALING EXERCISE APPARATUS

(71) Applicant: TOYOTA JIDOSHA KABUSHIKI KAISHA, Toyota (JP)

(72) Inventor: Eisuke Aoki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 103 days.

(21) Appl. No.: 17/553,266

(22) Filed: Dec. 16, 2021

(65) Prior Publication Data

US 2022/0193485 A1 Jun. 23, 2022

(30) Foreign Application Priority Data

Dec. 22, 2020 (JP) ..... 2020-212178

(51) Int. Cl.
*A63B 21/00* (2006.01)
*A63B 22/20* (2006.01)
*A63B 22/06* (2006.01)

(52) U.S. Cl.
CPC ..... *A63B 21/4034* (2015.10); *A63B 22/0664* (2013.01); *A63B 22/203* (2013.01); *A63B 2208/0233* (2013.01)

(58) Field of Classification Search
CPC ..... A63B 21/00058; A63B 21/00061; A63B 21/00065; A63B 21/00069; A63B 21/00178; A63B 21/04; A63B 21/0407; A63B 21/0414; A63B 21/055; A63B 21/0552; A63B 21/0555; A63B 21/0557;
(Continued)

(56) References Cited

U.S. PATENT DOCUMENTS 4,185,622 A 1/1980 Swenson
5,562,574 A 10/1996 Miller
(Continued)

FOREIGN PATENT DOCUMENTS

CN 101618261 A 1/2010
CN 102847268 A 1/2013
(Continued)

OTHER PUBLICATIONS

"PreStep Cop-Step", SAKAIMED, https://www.sakaimed.co.jp/rehabilitation/exercise-therapy/care_prevention/pre-step/, searched on Dec. 9, 2020.
(Continued)

*Primary Examiner* — Gary D Urbiel Goldner
(74) *Attorney, Agent, or Firm* — Dinsmore & Shohl LLP

(57) ABSTRACT

An exercise apparatus includes a pedal main part on which a user U in a sitting posture places his/her foot, a pedal support part configured to support the pedal main part so that the pedal main part is movable within a predetermined range along a foot-length direction, and a guiding mechanism configured to guide the pedal support part so that the pedal support part moves along a predetermined rotational trajectory in a cyclic manner. According to the above-described configuration, it is possible to prevent each of joints such as a hip joint, a knee joint, and an ankle joint from moving outside the range of movement of the joint. The exercise apparatus may also include a rubber tube that resists the movement of the pedal main part relative to the pedal support part.

5 Claims, 7 Drawing Sheets

(58) Field of Classification Search

CPC ..... A63B 21/4033; A63B 21/4034; A63B 21/4045; A63B 21/4049; A63B 22/0046; A63B 22/04; A63B 22/06; A63B 22/0664; A63B 22/0694; A63B 22/20; A63B 22/201; A63B 22/203; A63B 2022/0094; A63B 2022/0097; A63B 2022/0688; A63B 71/0009; A63B 71/0054; A63B 2071/0018; A63B 2071/0072; A63B 2208/0228; A63B 2208/0233

See application file for complete search history.

(56) References Cited

U.S. PATENT DOCUMENTS

| | | | | |
|---|---|---|---|---|
| 5,707,321 | A | 1/1998 | Maresh | |
| 5,836,855 | A | 11/1998 | Schenbach | |
| 5,857,941 | A | 1/1999 | Maresh et al. | |
| 5,879,271 | A * | 3/1999 | Stearns | A63B 22/0015 482/57 |
| 5,899,833 | A | 5/1999 | Ryan et al. | |
| 5,997,445 | A | 12/1999 | Maresh et al. | |
| 6,248,046 | B1 | 6/2001 | Maresh et al. | |
| 6,277,054 | B1 | 8/2001 | Kuo | |
| 6,340,340 | B1 * | 1/2002 | Stearns | A63B 22/0012 482/52 |
| 6,648,800 | B2 | 11/2003 | Stearns et al. | |
| 7,037,242 | B2 | 5/2006 | Lo et al. | |
| 7,182,714 | B2 | 2/2007 | Moon | |
| 7,201,705 | B2 | 4/2007 | Rodgers, Jr. | |
| 7,223,209 | B2 | 5/2007 | Lee | |
| 7,402,126 | B2 | 7/2008 | Chang | |
| 7,462,135 | B2 | 12/2008 | Lo | |
| 7,674,205 | B2 | 3/2010 | Dalebout et al. | |
| 7,896,780 | B2 | 3/2011 | Chen | |
| 8,047,968 | B2 | 11/2011 | Stewart et al. | |
| 8,210,993 | B2 | 7/2012 | Lee et al. | |
| 9,050,485 | B2 | 6/2015 | Huang et al. | |
| 9,597,540 | B2 | 3/2017 | Arnold | |
| 10,695,607 | B2 | 6/2020 | Teal et al. | |
| 2001/0011053 | A1 | 8/2001 | Miller | |
| 2004/0266588 | A1 * | 12/2004 | Miller | A63B 22/001 482/52 |
| 2005/0003932 | A1 | 1/2005 | Chen et al. | |
| 2006/0046902 | A1 | 3/2006 | Chang | |
| 2006/0172862 | A1 * | 8/2006 | Badarneh | A63B 22/001 482/52 |
| 2006/0223678 | A1 | 10/2006 | MacLean | |
| 2006/0252607 | A1 * | 11/2006 | Holloway | A63B 21/4049 482/62 |
| 2007/0060449 | A1 | 3/2007 | Lo | |
| 2007/0238582 | A1 | 10/2007 | Lee | |
| 2008/0161163 | A1 | 7/2008 | Stewart et al. | |
| 2009/0111663 | A1 | 4/2009 | Kuo | |
| 2009/0291808 | A1 | 11/2009 | Chen | |
| 2010/0010397 | A1 | 1/2010 | Ochi et al. | |
| 2011/0086743 | A1 | 4/2011 | Stewart | |
| 2011/0105280 | A1 | 5/2011 | Jhang et al. | |
| 2012/0115685 | A1 | 5/2012 | Bedell et al. | |
| 2014/0031175 | A1 * | 1/2014 | Peralo | A63B 21/4045 482/66 |
| 2014/0309086 | A1 | 10/2014 | Chuang | |
| 2016/0107026 | A1 * | 4/2016 | Hsu | A63B 22/0058 482/80 |
| 2017/0252603 | A1 * | 9/2017 | Wu | A63B 23/04 |
| 2018/0207474 | A1 * | 7/2018 | Chen | A63B 21/4034 |
| 2022/0118309 | A1 * | 4/2022 | Aoki | A63B 22/0025 |
| 2022/0331652 | A1 * | 10/2022 | Aoki | A61G 5/10 |
| 2022/0331653 | A1 * | 10/2022 | Takeda | A63B 22/20 |
| 2022/0331654 | A1 * | 10/2022 | Takeda | A63B 22/201 |
| 2022/0362628 | A1 * | 11/2022 | Polinsky | A63B 21/154 |
| 2022/0408927 | A1 * | 12/2022 | Aoki | A47C 3/0255 |
| 2022/0409955 | A1 * | 12/2022 | Aoki | A47C 9/002 |
| 2023/0146049 | A1 * | 5/2023 | Aoki | A63B 23/0476 482/7 |
| 2023/0148907 | A1 * | 5/2023 | Aoki | A61B 5/1107 73/379.01 |
| 2023/0149776 | A1 * | 5/2023 | Aoki | G16H 40/63 482/8 |
| 2023/0149777 | A1 * | 5/2023 | Aoki | A63B 24/0087 482/5 |

FOREIGN PATENT DOCUMENTS

| | | | |
|---|---|---|---|
| CN | 111530022 | A | 8/2020 |
| JP | H11-503660 | A | 3/1999 |
| JP | 2006-526456 | | 11/2006 |
| JP | 4015941 | B2 | 11/2007 |
| JP | 2008-104869 | A | 5/2008 |
| JP | 3165317 | U | 1/2011 |
| JP | 5319110 | B2 | 10/2013 |
| JP | 3210988 | U | 6/2017 |
| JP | 2019-111213 | A | 7/2019 |
| WO | 97-28848 | A1 | 8/1997 |
| WO | 2004-108223 | A1 | 12/2004 |

OTHER PUBLICATIONS

Non-Final Office Action dated Nov. 18, 2022, Issued to related U.S. Appl. No. 17/500,510, filed Oct. 13, 2021.

Final Office Action dated May 12, 2023, Issued to related U.S. Appl. No. 17/500,510, filed Oct. 13, 2021.

https://www.sakaimed.co.jp/rehabilitation/exercise-therapy/care_prevention/pre-step/.

https://www.irc-web.co.jp/cognibike.

Notice of Allowance dated Aug. 21, 2023, Issued to related U.S. Appl. No. 17/500,510, filed Oct. 13, 2021.

* cited by examiner

FOOT-PEDALING EXERCISE APPARATUS

CROSS REFERENCE TO RELATED APPLICATIONS

This application is based upon and claims the benefit of priority from Japanese patent application No. 2020-212178, filed on Dec. 22, 2020, the disclosure of which is incorporated herein in its entirety by reference.

BACKGROUND

The present disclosure relates to a foot-pedaling exercise apparatus.

Non-patent Literature 1 (https://www.sakaimed.co.jp/rehabilitation/exercise-therapy/care_prevention/pre-step/, searched on Dec. 9, 2020) discloses an exercise apparatus by which a user can perform an upper/lower limbs cooperative exercise while sitting therein. In the exercise apparatus disclosed in Non-patent Literature 1, a user performs an exercise along an elliptical trajectory by pressing pedals. Patent Literature 1 (Published Japanese Translation of PCT International Publication for Patent Application, No. H11-503660) discloses an exercise apparatus by which a user performs stepping motions in a standing position.

SUMMARY

The range of movement of a certain joint may become narrower, for example, after a person suffers hemiplegia caused by a stroke or osteoarthritis of a knee. In the foot-pedaling exercise apparatus disclosed in Non-patent Literature 1, in some cases, a joint moves beyond the range of movement thereof, causing a pain thereof. There is thus a demand for a foot-pedaling exercise apparatus that a user would be able to use within a narrowed range of movement of a joint.

An object of the present disclosure is to provide a foot-pedaling exercise apparatus that prevents a joint from moving outside the range of movement of the joint.

A first exemplary aspect is a foot-pedaling exercise apparatus including: a pedal main part on which a user in a sitting posture places his/her foot; a pedal support part configured to support the pedal main part so that the pedal main part is movable within a predetermined range along a foot-length direction; and a guiding mechanism configured to guide the pedal support part so that the pedal support part moves along a predetermined rotational trajectory in a cyclic manner. According to the above-described configuration, it is possible to prevent a joint from moving outside the range of movement of the joint.

The foot-pedaling exercise apparatus may further include resistive means for resisting the movement of the pedal main part relative to the pedal support. According to the above-described configuration, it is possible to prevent an unintended movement of the pedal main part relative to the pedal support part.

The resistive means may be an elastic member connecting the pedal support part with the pedal main part, and extending along the foot-length direction. According to the above-described configuration, the resistive means can be implemented at a low price.

The elastic member may be attached to the pedal support part at two different places in the foot-length direction, and the pedal main part may be attached to the elastic member at a place between the two places. According to the above-described configuration, the resistive means can be implemented at a low price.

The pedal main part may be detachably attached to the elastic member. According to the above-described configuration, it is possible to change the resisting force applied by the resistive means according to the direction in which the pedal main part is moved relative to the pedal support part. For example, by fixing the pedal main part to the elastic member at a position close to the toe, a strong resistance is applied to the pedal main part when the pedal main part is moved toward the heel side relative to the pedal support part, so that it is possible to simulate a movement that is performed when a user kicks the ground at a stance-leg state. Further, in this case, it is possible to secure a large amount of a movement toward the heel side, and thereby to simulate walking with a large stride length. On the other hand, by fixing the pedal main part to the elastic member at a position close to the heel, a strong resistance is applied to the pedal main part when the pedal main part is moved toward the toe side relative to the pedal support part.

The elastic member may be a rubber tube.

According to the present disclosure, it is possible to prevent a joint from moving outside the range of movement of the joint.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Figure 1:
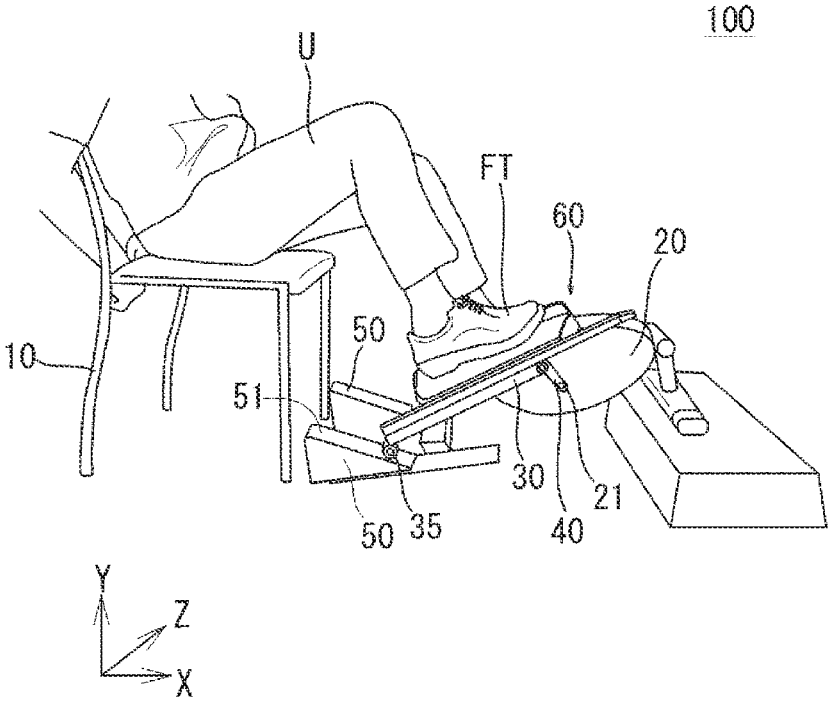
FIG. 1 is a perspective view schematically showing a configuration of an exercise apparatus.

The present disclosure will be explained hereinafter through embodiments according to the present disclosure. However, the below-shown embodiments are not intended to limit the scope of the present disclosure specified in the claims. Further, not all of the components/structures described in the embodiments are necessarily indispensable as means for solving the problem. For clarifying the explanation, the following description and the drawings are partially omitted and simplified as appropriate. The same reference numerals (or symbols) are assigned to the same elements throughout the drawings and redundant explanations thereof are omitted as appropriate.

Figure 2:
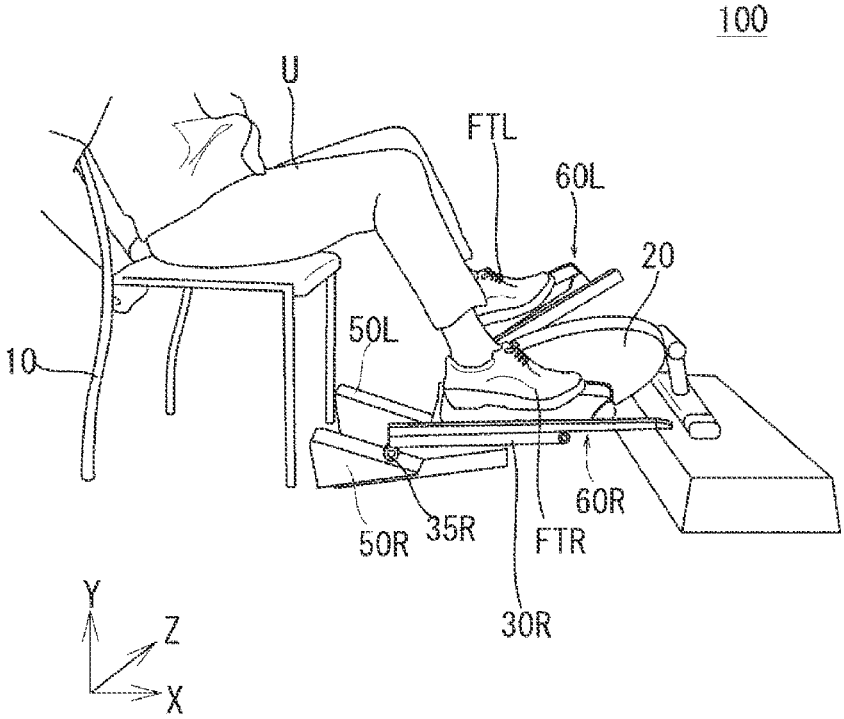
FIG. 2 is a perspective view schematically showing the configuration of the exercise apparatus.

An exercise apparatus according to an embodiment is a foot-pedaling exercise apparatus by which a user performs a foot-pedaling exercise. An exercise apparatus 100 according to this embodiment will be described with reference to FIGS. 1 and 2. FIGS. 1 and 2 are side views of the exercise apparatus 100. Note that, for clarifying the explanation, the following description is given while using an XYZ 3D (three-dimensional) orthogonal coordinate system. Specifically, the +X direction is the forward direction; the −X direction is the rearward direction; the +Y direction is the upward direction; the −Y direction is the downward direction; the +Z direction is the leftward direction; and the −Z direction is the rightward direction. The front-rear direction, the left-right direction, and the up-down direction are directions based on the direction of a user U.

The exercise apparatus 100 is one in which the movable ranges of ankle joints can be adjusted. In the following description, the rotational direction of an ankle joint about the Z-axis is referred to as a plantar/dorsi-flexion direction and the angle thereof is referred to as a plantar/dorsi-flexion angle. More specifically, a direction in which the toe of a foot FT points downward is referred to as a plantar-flexion direction, and a direction in which the toe points upward is referred to as a dorsiflexion direction.

As shown in FIG. 1, the exercise apparatus 100 includes a main-body part 20, links 30, pedal units 60, cranks 40, and tilt tables 50. A chair 10 is provided behind the exercise apparatus 100. A user U performs a foot-pedaling exercise while sitting on the chair 10. Therefore, the chair 10 serves as a sitting part on which the user U sits. Note that the chair 10 may be provided integrally with the exercise apparatus 100 (i.e., provided as a part of the exercise apparatus 100), or may be provided as a separate apparatus. For example, the chair 10 may be a chair present in an institution where the user U is present, the user's house, or the like. That is, the user U or his/her assistant may place such a chair 10 behind the exercise apparatus 100.

Note that, in the exercise apparatus 100, the components attached to the main-body part 20 are symmetrical in the left-right direction. In FIG. 2, in order to distinguish the components on the left side of the main main-body part 20 from those on right side thereof, the components on the left side are indicated by a suffix "L" and those on the right side are indicated by a suffix "R". For example, in FIG. 2, the left tilt table 50 is referred to as a tilt table 50L, and the right tilt table 50 is referred to as a tilt table 50R. Similarly, the left pedal unit 60 is referred to as a pedal unit 60L, and the right link 30 and the right pedal unit 60 are referred to as a link 30R and a pedal unit 60R, respectively. Similarly, the left foot FT is referred to as a left foot FTL, and the right foot FT is referred to as a right foot FTR. Note that, in the following description, when the left and right components are not distinguished from each other, the suffixes L and R are omitted.

The main-body part 20 rotatably holds the cranks 40. For example, a rotation shaft 21 is provided in the main-body part 20. The cranks 40 are connected to the rotation shaft 21. The cranks 40 rotate about the rotation shaft 21. The main-body part 20 may include a resistive load member that gives a load to the rotational movements of the cranks 40. Note that the main-body part 20 may include a gear or the like that changes the amount of the load. The main-body part 20 may be fixed to a floor surface.

Each of the links 30 includes a sliding wheel 35. The cranks 40 are connected to the front ends of the links 30, and the sliding wheels 35 are connected to the rear ends of the links 30. The cranks 40 and the links 30 are rotatably connected to each other. For example, each of the links 30 is attached to a respective one of the cranks 40 with a bearing or the like interposed therebetween. The pedal units 60 are attached to the links 30, respectively.

Figure 3:
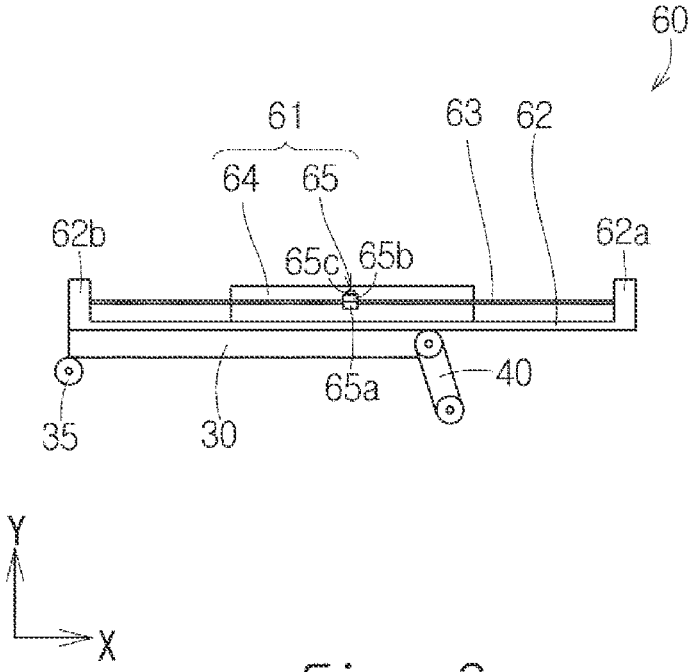
FIG. 3 is a side view of a pedal unit.

FIG. 3 shows the pedal unit 60 attached to the link 30. As shown in FIG. 3, each of the pedal units 60 includes a pedal main part 61, a pedal support part 62, and a rubber tube 63.

The pedal main part 61 includes a step 64 on which the user U places his/her foot FT, and a tube clamp 65 for connecting the step 64 to an arbitrary place of the rubber tube 63. The tube clamp 65 includes a tube receiving part 65*a* fixed to a side of the step 64, a tube cover part 65*b* opposed to the tube receiving part 65*a* in the Y-direction, and a screw mechanism 65*c* that exerts a clamping force by which it presses the tube cover part 65*b* against the tube receiving part 65*a* with the rubber tube 63 being interposed between the tube receiving part 65*a* and the tube cover part 65*b*.

The pedal support part 62 supports the pedal main part 61 so that the pedal main part 61 is movable within a predetermined range along the foot-length direction. Specifically, the pedal support part 62 supports the pedal main part 61 so that the pedal main part 61 is movable along the longitudinal direction of the link 30. The pedal support part 62 is fixed to the link 30. The pedal support part 62 extends along the longitudinal direction of the link 30. An end of the link 30 on the heel side and an end 62*b* of the pedal support part 62 on the heel side are aligned in the longitudinal direction of the link 30. An end 62*a* of the pedal support part 62 on the toe side protrudes toward the toe-side farther than (i.e., beyond) an end of the link 30 on the toe side. Therefore, the link 30 is shorter than the pedal support part 62. In this embodiment, the length of the link 30 is roughly two thirds of the length of the pedal support part 62.

One end of the rubber tube 63 is fixed to the toe-side end 62*a* of the pedal support part 62, and the other end of the rubber tube 63 is fixed to the heel-side end 62*b* of the pedal support part 62. That is, the rubber tube 63 extends from the end 62*a* of the pedal support part 62 to the end 62*b* thereof. The rubber tube 63 is stretched over the pedal support part 62 in a slightly stretched state. Alternatively, the rubber tube 63 may be stretched over the pedal support part 62 in an un-stretched state (and an un-slacken state). The rubber tube 63 is a specific example of the elastic member. As the elastic member, a rubber band or a coil spring may be used instead of using the rubber tube.

In this embodiment, the pedal main part 61 is connected to the rubber tube 63 so that the step 64 is positioned at the center between the end 62*a* of the pedal support part 62 and the end 62*b* thereof in a state in which no foot FT is placed on the pedal main part 61. In this neutral state, when the pedal main part 61 moves toward the toe side relative to the pedal support part 62, the rubber tube 63 is stretched between the pedal main part 61 and the end 62*b*, and hence the pedal main part 61 is pulled toward the heel side relative to the pedal support part 62 by the elastic restoring force of the rubber tube 63. Similarly, in the aforementioned neutral state, when the pedal main part 61 moves toward the heel side relative to the pedal support part 62, the rubber tube 63 is stretched between the pedal main part 61 and the end 62*a*, and hence the pedal main part 61 is pulled toward the toe side relative to the pedal support part 62 by the elastic restoring force of the rubber tube 63.

Referring to FIG. 1 again, the sliding wheel 35 is attached to the link 30 through a rotation shaft (an axle). That is, the link 30 rotatably holds the sliding wheel 35. The sliding wheel 35 serves as a moving member that moves on an inclined surface 51 of the tilt table 50 (In this specification, the meaning of the term "sliding" includes movements in which the sliding wheel 35 moves on the surface while rotating thereon).

The user U places his/her feet FT on the steps 64 of the pedal main parts 61 of the pedal units 60, and performs a foot-pedaling exercise. That is, the user U moves his/her knee joints and the hip joints so that the user U presses the pedals with his/her feet FT. In this way, the cranks 40 rotate about the rotation shaft 21. Further, the angle between each of the links 30 and a respective one of the cranks 40 changes according to the rotation of that crank 40. That is, the relative angle of each of the links 30 with respect to a respective one of the cranks 40 changes according to the rotation angle of that crank 40 (which is also referred to as a crank angle). Further, the sliding wheel 35 moves in the front-rear direction while remaining in contact with the inclined surface 51 of the tilt table 50. In this way, the cranks 40 and the links 30 are rotated in such a manner that each of the pedal support parts 62 of the pedal units 60 moves along an elliptical trajectory according to the foot-pedaling motion. The elliptical trajectory is a specific example of the rotational trajectory. A circular trajectory may be adopted as the rotational trajectory.

The main-body part 20, the link 30, the crank 40, and the tilt table 50 constitute a guiding mechanism that guides the pedal support part 62 so that the pedal support part 62 moves along a predetermined rotational trajectory in a cyclic manner.

Note that the pedal unit 60, the sliding wheel 35, the link 30, the crank 40, and the tilt table 50 are provided for each of the left and right feet FT of the user U. That is, the pedal unit 60, the sliding wheel 35, the link 30, the crank 40, and the tilt table 50 are provided on each of the left and right sides of the main-body part 20. The pedal unit 60R, the sliding wheel 35R, the link 30R, the tilt table 50R, and the like provided on the right side of the main-body part 20 correspond to the right foot FTR of the user U. The pedal unit 60L, the sliding wheel 35L, the link 30L, the tilt table 50L, and the like provided on the left side of the main-body part 20 correspond to the left foot FTL of the user U.

The cranks 40 are attached to the rotation shaft 21 of the main-body part 20 in such a manner that the phases of the crank 40 for the left foot FT and that for right feet FT are opposite to each other. That is, the rotation angle of the crank 40 for the left foot and that of the crank 40 for the right foot are shifted from each other by 180°. The user U performs a foot-pedaling exercise by stretching and bending the left and the right legs in an alternating manner.

The sliding wheel 35 is attached to the lower end of each of the links 30. The sliding wheel 35 includes a wheel that moves on an inclined surface 51 of the tilt table 50. The tilt table 50 has the inclined surface 51 which is inclined so that the tilt table 50 becomes higher toward the rear thereof. The sliding wheel 35 performs a reciprocating movement in the X-direction (the front-rear direction) according to the rotational movement of the link 30. As shown in FIG. 1, while the user U performs a foot-pedaling motion by stretching the right leg and bending the left leg, the sliding wheel 35 on the right side moves forward and the sliding wheel 35 on the left side moves rearward. As shown in FIG. 2, while the user U performs a foot-pedaling motion by stretching the left leg and bending the right leg, the sliding wheel 35 on the left side moves forward and the sliding wheel 35 on the right side moves rearward.

The height of the sliding wheel 35 changes along the inclined surface 51 of the tilt table 50. The inclined surface 51 of the tilt table 50 becomes higher toward the rear thereof. That is, the tilt table 50 becomes an upslope for the sliding wheel 35 that is moving rearward. Therefore, while the sliding wheel 35 is moving rearward, the position of the sliding wheel 35 is gradually raised. On the other hand, while the sliding wheel 35 is moving forward, the position of the sliding wheel 35 is gradually lowered. The angle of the link 30 is determined according to the height of the sliding wheel 35.

Note that the angle of the pedal unit 60 disposed in the link 30 is restricted according to the height of the sliding wheel 35. That is, when the sliding wheel 35 is raised, the pedal unit 60 rotates in the plantar-flexion direction. When the sliding wheel 35 is lowered, the pedal unit 60 rotates in the dorsiflexion direction. Therefore, it is possible to adjust the movable range of the plantar/dorsi-flexion angle of the ankle joint according to the inclination angle of the tilt table 50. It is possible to adjust the movable range of the plantar/dorsi-flexion angle of the ankle joint according to the rotation angle of the crank 40.

Figure 4:
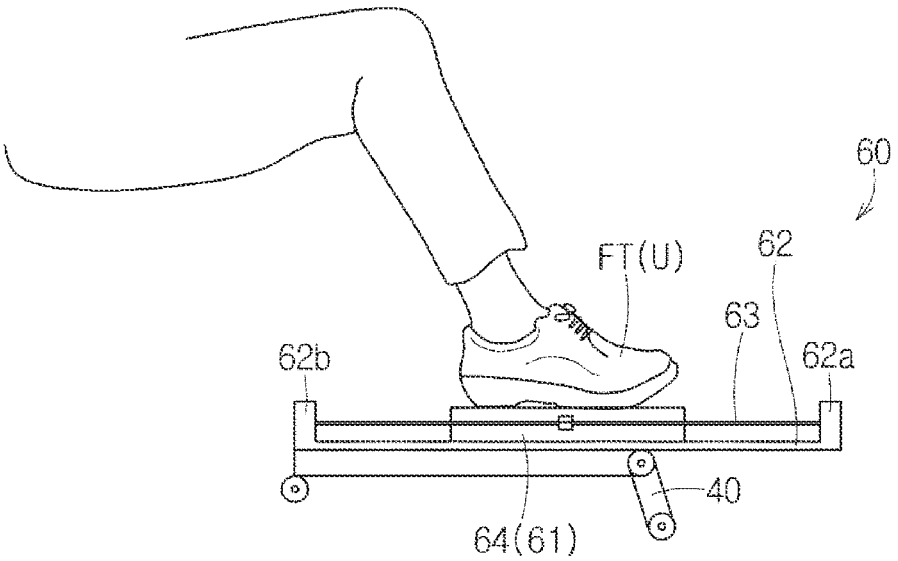
FIG. 4 is a side view of the pedal unit, showing a state in which a user placed his/her foot on a pedal main part and has slid the pedal main part toward the heel side.
Figure 5:
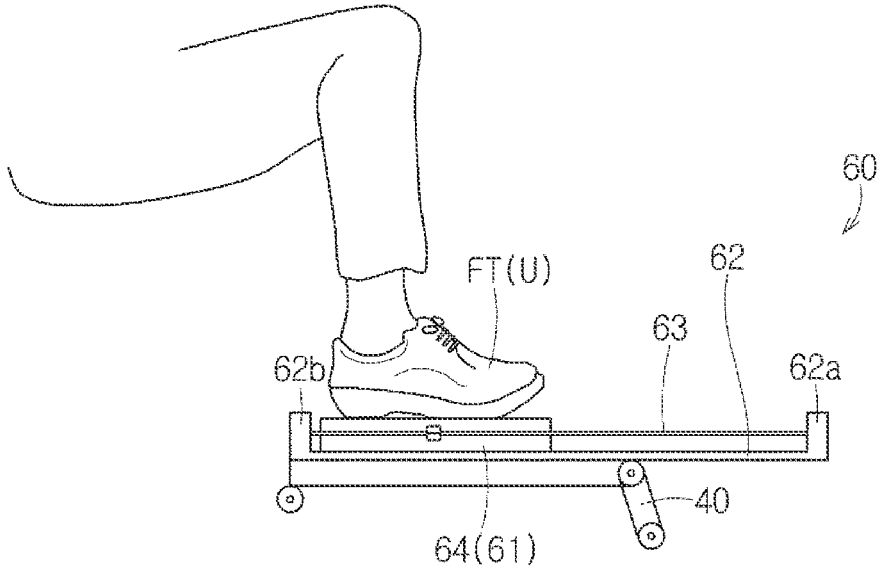
FIG. 5 is a side view of the pedal unit, showing a state in which the user placed his/her foot on the pedal main part and has slid the pedal main part toward the toe side.
Figure 6:
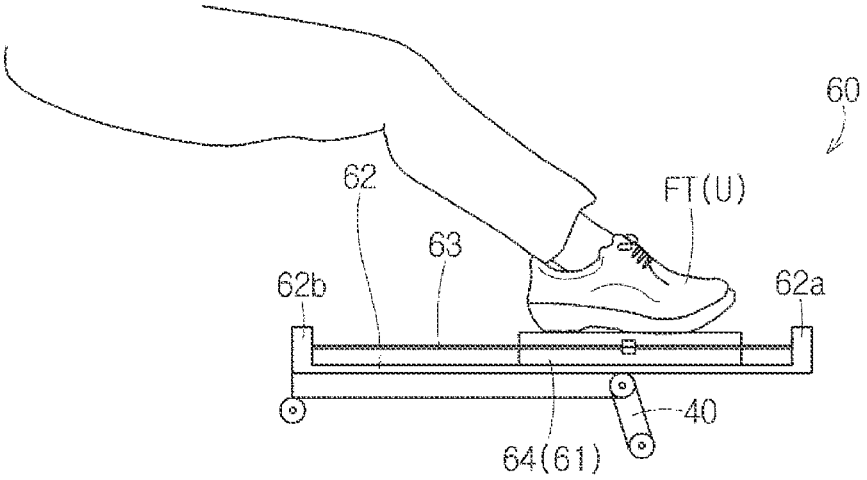
FIG. 6 is a side view of the pedal unit, showing a state in which the user placed his/her foot on the pedal main part.

FIG. 4 shows a state in which the user U places his/her foot FT on the step 64 of the pedal main part 61. FIG. 5 shows a state in which the pedal main part 61 has moved backward relative to the pedal support part 62. FIG. 6 shows a state in which the pedal main part 61 has moved forward relative to the pedal support part 62.

As described above, since the pedal main part 61 is movable in the foot-length direction relative to the pedal support part 62, it is possible to prevent each joint from having a joint angle outside the range of movement of that joint during the foot-pedaling exercise using the exercise apparatus 100.

For example, when the ankle joint is about to be extended (i.e., stretched) in the plantar-flexion direction beyond the limit of the joint angle of that ankle joint in the plantar-flexion direction, the pedal main part 61 moves toward the heel side relative to the pedal support part 62, and thereby can prevent the ankle joint from being extended (i.e., stretched) in the plantar-flexion direction.

Similarly, for example, when the ankle joint is about to be extended (i.e., stretched) in the dorsiflexion direction beyond the limit of the joint angle of that ankle joint in the dorsiflexion direction, the pedal main part 61 moves toward the toe side relative to the pedal support part 62, and thereby can prevent the ankle joint from being extended (i.e., stretched) in the dorsiflexion direction.

Therefore, even when the movable range of the joint angle of the ankle joint is narrow as compared to the movable range thereof in a healthy state (or as compared to the movable range thereof of a healthy person), the user can perform, by using the exercise apparatus 100, a foot-pedaling exercise without difficulty. The same applies when the movable range of the joint angle of a knee joint or a hip joint is narrow as compared to the movable range thereof in a healthy state (or as compared to the movable range thereof of a healthy person).

Further, by making the pedal main part 61 movable in the foot-length direction relative to the pedal support part 62, it is possible to increase the elliptical trajectory, typically, the long axis of the elliptical trajectory, along which the pedal main part 61 moves. Note that the length of the long axis of the elliptical trajectory is directly proportional to the range of changes of the joint angle of the knee joint during the foot-pedaling motion. Therefore, by making the pedal main part 61 movable in the foot-length direction relative to the pedal support part 62, it becomes possible to flexibly respond to various ranges of changes of the joint angle of the knee joint.

Note that, as shown in FIG. 1, typically, while a user U is performing a foot-pedaling motion in a direction in which he/she stretches the right leg and bends the left leg, the pedal main part 61 on the right side moves forward relative to the pedal support part 62 on the right side as shown in FIG. 6, and the pedal main part 61 on the left side moves backward relative to the pedal support part 62 on the left side as shown in FIG. 5. As shown in FIG. 2, while the user U is performing a foot-pedaling motion in a direction in which he/she stretches the left leg and bends the right leg, the pedal main part 61 on the right side moves backward relative to the pedal support part 62 on the right side as shown in FIG. 5, and the pedal main part 61 on the left side moves forward relative to the pedal support part 62 on the left side as shown in FIG. 6.

Further, the exercise apparatus 100 is an exercise apparatus by which a user can train (i.e., build up) his/her quadriceps and iliopsoas muscles at the same time. Since the pedal main part 61 slides back and forth during the foot-pedaling exercise, it is possible to obtain such an exercising effect that the range of movement of the knee joint is extended in both the stretching side and the bending side just by performing foot-pedaling motions. In the exercise apparatus 100, the fact that suppressing the contraction of antagonist muscles and preventing the secondary limitation of the range of movement of the joint or the delay of the improvement of the joint angle range are important is taken into consideration. When the knee joint is extended, the ankle joint is in a plantar-flexion position as shown in FIG. 6, and when the knee joint is bent, the ankle joint is in a dorsiflexion position as shown in FIG. 5. Therefore, it is possible to secure a large range of changes of the joint angle of the ankle joint during the foot-pedaling motion.

An embodiment according to the present disclosure has been described above, and the above-described embodiment has the following features.

An exercise apparatus 100 includes a pedal main part 61 on which a user U (a user) in a sitting posture places his/her foot, a pedal support part 62 configured to support the pedal main part 61 so that the pedal main part 61 is movable within a predetermined range along a foot-length direction, and a guiding mechanism configured to guide the pedal support part 62 so that the pedal support part 62 moves along a predetermined rotational trajectory in a cyclic manner. According to the above-described configuration, it is possible to prevent each of joints such as a hip joint, a knee joint, and an ankle joint from moving outside the range of movement of the joint. In the above-described embodiment, the guiding mechanism is composed of the main-body part 20, the link 30, the crank 40, and the tilt table 50.

Further, the exercise apparatus 100 also includes the rubber tube 63 (resistive means) that resists the movement of the pedal main part 61 relative to the pedal support part 62. According to the above-described configuration, it is possible to prevent an unintended movement of the pedal main part 61 relative to the pedal support part 62, and thereby to achieve a smooth foot-pedaling motion.

Further, the rubber tube 63 (resistive member) is an elastic member that connects the pedal support part 62 with the pedal main part 61, and extends along the foot-length direction. According to the above-described configuration, the resistive means can be implemented at a low price.

Further, the rubber tube 63 is attached to the pedal support part 62 at two different places (ends 62*a* and 62*b*) in the foot-length direction. The pedal main part 61 is attached to the elastic member at a place between the two places (ends 62*a* and 62*b*). According to the above-described configuration, the resistive means can be implemented at a low price.

Figure 7:
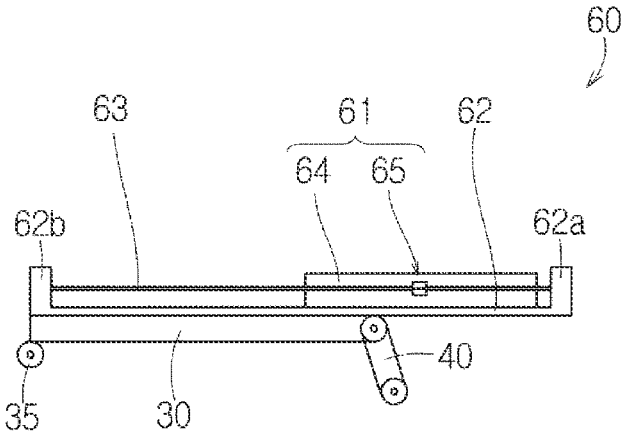
FIG. 7 is a side view of the pedal unit, in which the pedal main part is attached on the toe side.
Figure 8:
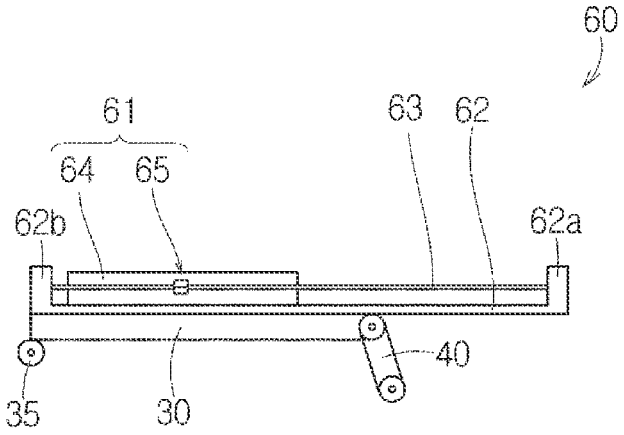
FIG. 8 is a side view of the pedal unit, in which the pedal main part is attached on the heel side.

The pedal main part 61 is detachably attached to the rubber tube 63. According to the above-described configuration, it is possible to change the resisting force applied by the rubber tube 63 according to the direction in which the pedal main part 61 is moved relative to the pedal support part 62. For example, as shown in FIG. 7, by fixing the pedal main part 61 to the rubber tube 63 at a position close to the end 62*a*, a strong resistance is applied to the pedal main part when the pedal main part 61 is moved toward the heel side relative to the pedal support part 62, so that it is possible to simulate a movement that is performed when a user kicks the ground at a stance-leg state. Further, in this case, it is possible to secure a large amount of a movement toward the heel side, and thereby to simulate walking with a large stride length. Therefore, it is expected that an exercising effect that the range of movement of the joint is extended can be obtained. On the other hand, as shown in FIG. 8, by fixing the pedal main part 61 to the rubber tube 63 at a position close to the end 62*b*, a strong resistance is applied to the pedal main part when the pedal main part 61 is moved toward the toe side relative to the pedal support part 62.

Further, the tilt table 50 and the sliding wheel 35 shown in FIGS. 1 and 2 are not indispensable. In the above-described embodiment, the guiding mechanism is composed of the main-body part 20, the link 30, the crank 40, and the tilt table 50. Alternatively, the guiding mechanism may be composed of the main-body part 20, the link 30, and the crank 40.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A foot-pedaling exercise apparatus comprising:

a pedal main part configured for a user in a sitting posture to place his/her foot thereupon;

a pedal support part comprising a toe-side end and a heel-side end, and configured to support the pedal main part so that the pedal main part is movable within a predetermined range along a foot-length direction of the pedal support part;

a guiding mechanism comprising a main body part, a link, a crank, and a tilt table, the guiding mechanism configured to guide the pedal support part so that the pedal support part moves along a predetermined rotational trajectory in a cyclic manner; and an elastic member configured to resist the movement of the pedal main part relative to the pedal support part, the elastic member connecting the pedal support part with the pedal main part and extending continuously between the toe-side end and the heel side end along the foot-length direction of the pedal support part.

2. The foot-pedaling exercise apparatus according to claim 1, wherein the elastic member is attached to the pedal support part at two different places in the foot-length direction, and the pedal main part is attached to the elastic member at a place between the two different places.

3. The foot-pedaling exercise apparatus according to claim 2, wherein the pedal main part is detachably attached to the elastic member.

4. The foot-pedaling exercise apparatus according to claim 3, wherein the pedal main part includes a clamp having a receiving part and a cover part, the elastic member being coupled between the receiving part and the cover part.

5. The foot-pedaling exercise apparatus according to claim 1, wherein the elastic member is a rubber tube.

* * * * *